US006699089B2

(12) United States Patent
Ninomiya

(10) Patent No.: US 6,699,089 B2
(45) Date of Patent: Mar. 2, 2004

(54) SHEATHED GLOW PLUG AND METHOD OF MANUFACTURING THE SAME

(75) Inventor: Katsunari Ninomiya, Toukai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 167 days.

(21) Appl. No.: 09/983,920

(22) Filed: Oct. 26, 2001

(65) Prior Publication Data

US 2002/0025754 A1 Feb. 28, 2002

Related U.S. Application Data

(63) Continuation of application No. PCT/JP01/01467, filed on Feb. 27, 2001.

(30) Foreign Application Priority Data

Feb. 28, 2000 (JP) ..... P.2000-50700

(51) Int. Cl.[7] ..... H01T 21/02
(52) U.S. Cl. ..... 445/7; 313/141; 313/143
(58) Field of Search ..... 445/7; 313/141, 313/143, 118, 144, 137; 123/145 A, 145 R; 219/57, 58, 101, 117.1; 29/611

(56) References Cited

U.S. PATENT DOCUMENTS 4,273,983 A * 6/1981 Ogawa et al. ..... 219/93
4,288,024 A * 9/1981 Nippert ..... 219/119
4,308,446 A * 12/1981 Okane et al. ..... 219/123
4,380,973 A * 4/1983 Steinke ..... 123/145 A
4,423,617 A * 1/1984 Nippert ..... 29/825
4,806,734 A * 2/1989 Masaka et al. ..... 123/145 A
5,565,117 A * 10/1996 Iwasa et al. ..... 219/117.1
5,611,945 A * 3/1997 Kuwabara et al. ..... 219/119
5,783,794 A * 7/1998 Oikawa et al. ..... 219/118
6,373,021 B1 * 4/2002 Wang et al. ..... 219/117.1
6,448,532 B1 * 9/2002 Mittler et al. ..... 219/117.1

FOREIGN PATENT DOCUMENTS

JP 58-013481 * 1/1983 ..... B23K/11/32
JP 4-15407 1/1992
JP 4-24420 1/1992
JP 5-332539 12/1993

* cited by examiner

*Primary Examiner*—Dean A. Reichard
*Assistant Examiner*—Angel R. Estrada
(74) *Attorney, Agent, or Firm*—Morgan, Lewis & Bockius LLP

(57) ABSTRACT

A method of manufacturing a sheathed glow plug, the glow plug comprising: a cylindrical main metal shell; a heat resisting tube mounted to a leading end of a through hole of the main metal shell; a center electrode, that comprises a leading end axial shaft and a rear end axial shaft coaxially welded each other, disposed in a center portion of the through hole of the main metal shell; and an electric heat generator received in the heat resisting tube, the electric heat generator having one end electrically connected to the center electrode, which comprises a process of manufacturing the center electrode comprising the steps of: making a diameter of a connecting end of one of the axial shafts smaller than a diameter of a connecting end of the other axial shaft; disposing the leading end axial shaft and the rear end axial shaft on the same axis; bringing the connecting ends into contact; and connecting them by a resistance welding after bringing of the connecting ends.

8 Claims, 11 Drawing Sheets

| ϕD(mm) | ϕd(mm) | A(mm) | ECCENTRICITY BETWEEN AXIAL SHAFTS A AND B (mm) |
|---|---|---|---|
| 5.0 | 3.6 | 6.0 | *0.22 |
| 4.0 | 2.9 | 5.0 | *0.21 |
| 4.0 | 2.7 | 4.8 | *0.19 |
| 3.2 | 2.9 | 4.0 | *0.19 |
| 3.2 | 2.7 | 3.9 | *0.23 |

*COMBINATION IN WHICH A(BURR OUTER DIAMETER)EXCEEDS ϕD (OUTER DIAMETER OF THICKER AXIAL SHAFT)

STEPPED SHAPE OF AXIAL SHAFT LEADING END PORTION

| ϕD(mm) | ϕB(mm) | ϕd(mm) | A(mm) | ECCENTRICITY BETWEEN AXIAL SHAFTS A AND B (mm) |
|---|---|---|---|---|
| 5.0 | 2.5 | 3.6 | 5.3 | *0.16 |
| 4.0 | 2.0 | 2.9 | 4.2 | *0.17 |
| 4.0 | 2.0 | 2.7 | 4.0 | 0.14 |
| 3.2 | 2.0 | 2.9 | 3.6 | *0.13 |
| 3.2 | 2.0 | 2.7 | 3.4 | *0.16 |

*COMBINATION IN WHICH A(BURR OUTER DIAMETER)EXCEEDS ϕD (OUTER DIAMETER OF THICKER AXIAL SHAFT)

TAPERING SHAPE OF AXIAL SHAFT LEADING END PORTION

| $\phi$D(mm) | $\phi$B(mm) | $\phi$d(mm) | A(mm) | ECCENTRICITY BETWEEN AXIAL SHAFTS A AND B (mm) |
|---|---|---|---|---|
| 5.0 | 2.0 | 3.6 | 4.9 | 0.13 |
| 4.0 | 1.5 | 2.9 | 4.0 | 0.10 |
| 4.0 | 1.5 | 2.7 | 3.9 | 0.09 |
| 3.2 | 1.5 | 2.9 | 3.3 | *0.15 |
| 3.2 | 1.5 | 2.7 | 3.1 | 0.11 |

*COMBINATION IN WHICH A(BURR OUTER DIAMETER)EXCEEDS $\phi$D (OUTER DIAMETER OF THICKER AXIAL SHAFT)

| $\phi$D, $\phi$d(mm) | A(mm) | ECCENTRICITY BETWEEN AXIAL SHAFTS A AND B (mm) |
|---|---|---|
| 5.0 | 6.5 | 0.39 |
| 4.0 | 5.4 | 0.35 |
| 3.2 | 4.3 | 0.34 |

SHEATHED GLOW PLUG AND METHOD OF MANUFACTURING THE SAME

This application is a continuation of PCT/JP01/01467 filed Feb. 27, 2001.

FIELD OF THE INVENTION

The present invention relates to a sheathed glow plug used in starting aids for internal combustion engines such as diesel engine, and in sheathed heater, liquid heating devices and the like, and to a method of manufacturing the same.

BACKGROUND OF THE INVENTION

Various proposals are made for a sheathed glow plug comprising a cylindrical main metal shell, a heat resisting tube mounted in a leading end of a through hole of the main metal shell, a center electrode disposed in a center portion of the through hole of the main metal shell and an electric heat generator electrically connected to the center electrode, which is accommodated in the heat resisting tube and disposed between the center electrode and the heat resisting tube, wherein the center electrode is composed by coaxially welding a leading end axial shaft and a rear end axial shaft.

As shown in FIG. 9, hitherto, a center electrode (a) used in the sheathed glow plug is formed by welding a leading end axial shaft (b) and a rear end axial shaft (c) whose connecting end's diameter is the same as that of the former axial shaft such that their connecting ends are mutually coaxial. By the way, in case that their butting faces are not correctly at right angle with respect to an axis, a coaxial property between both axial shafts is deteriorated. Further, as shown in FIG. 9, if there is a tiny protruded portion (d) on a connecting/contacting face, the protruded portion (d) first contacts and a melting is concentrated to this portion. Therefore, a molten metal flows to this portion and thus a deviation of bonded state in a face direction occurs and, thereby, such a case occurs that a regular face-connecting is not performed and this becomes a cause of an eccentricity as well.

On the other hand, recently, a diesel engine of direct injection type becomes a main stream and, corresponding to this, a glow plug whose length is capable of reaching a combustion chamber of the engine has been demanded. By the way, if the glow plug is made long in this manner, it becomes impossible to neglect a minute eccentricity generated when the leading end axial shaft and the rear end axial shaft are bonded, and it follows that there is generated such a case that the glow plug contacts with an inner face of the through hole of the main metal shell, so that a short-circuit occurs. Therefore, it has become a recent important problem to perform the connecting between both axial shafts as regularly as possible without the eccentricity Additionally, by mutually welding faces of connecting end of axial shafts (a) and (b), a molten metal protrudes in a periphery of that connecting portion to form a burr (x) (refer to FIG. 10). If the burr(x)is left as it is, since the burr (x) contacts with an inner face of a main metal shell to generate an electric short-circuit, it is necessary to remove the burr by means such as a grinder. By the way, hitherto, a maximum size of the burr becomes larger in its diameter than the axial shaft. And, in order to ensure an insulation between an inner face of the through hole of the main metal shell and the center electrode, it is necessary to approximately completely remove the burr, so that a time is required in the removal process. Further, in case that the burr removal is performed by the grinder, since a work is magnetized, it is necessary to perform a demagnetization treatment, so that there have been problems that a process is increased, the connecting face periphery is shaved and becomes brittle, and a strength is lowered.

An object of the invention is to solve the problems of such a conventional constitution.

DETAILED DESCRIPTION OF THE INVENTION

The invention is a method of manufacturing a sheathed glow plug, the glow plug comprising: a cylindrical main metal shell; a heat resisting tube mounted to a leading end of a through hole of the main metal shell; a center electrode, that comprises a leading end axial shaft and a rear end axial shaft coaxially welded each other, disposed in a center portion of the through hole of the main metal shell; and an electric heat generator received in the heat resisting tube, the electric heat generator having one end electrically connected to the center electrode, which comprises a process of manufacturing the center electrode comprising the steps of: making a diameter of a connecting end of one of the axial shafts smaller than a diameter of a connecting end of the other axial shaft; disposing the leading end axial shaft and the rear end axial shaft on the same axis; bringing the connecting ends into contact; and connecting them by a resistance welding after bringing of the connecting ends.

In such a constitution, the butting face between the connecting ends becomes a small area depending on the diameter of the connecting end having a smaller diameter and, after such butting face has been preferentially molten, the other portion is welded. Therefore, even if a connecting end face has an error of right angle degree or becomes a rough face, its influence can be suppressed because the diameter of the butting face is small, so that the resistance welding can be stably performed. Further, even if a burr is generated in a periphery edge of the connecting face by the resistance welding, a burr generation amount becomes small because an area of the butting face is small. And, so long as the burr does not protrude the main diameter of the axial shaft having a larger diameter, it becomes an allowable range, so that a burr removable can be omitted or a simple burr removal work suffices.

As a constitution capable of achieving a mutual diameter relation of the connecting ends, there is proposed a constitution in which the connecting end of one axial shaft of the center electrode is made smaller in its diameter than its main diameter and the diameter of that connecting end is made smaller than the connecting end of the other axial shaft. In such a constitution, since it is one in which the main diameters of the axial shafts are made different and the connecting end of the axial shaft having a larger diameter is made smaller in its diameter than the connecting end of the other axial shaft, the diameter of the connecting end having a small diameter prescribing the butting face can be made as small as possible without making the diameters of both axial shafts small so much. Therefore, it is possible to regularly bond the axial shafts together without reducing a strength of the center electrode to improve a coaxial degree. Further, since the diameter of the butting face is small, the maximum size of the burr becomes small as well, so that the burr removal becomes easy or unnecessary.

As such a constitution, there is proposed one in which the connecting end is formed by forming, in a connecting side end portion of one axial shaft of the center electrode, a different diameter protruded portion having a smaller diameter than a main diameter portion, thereby making the diameter of that connecting end smaller than the connecting end of the other axial shaft.

Further, there is proposed a constitution in which the connecting end is formed in the connecting side end portion of one axial shaft of the center electrode by forming a tapering truncated cone portion, thereby making the diameter of that connecting end smaller than the connecting end of the other axial shaft. By making it into a truncated cone form in this manner, it is possible to reduce an area of the connecting end preferentially bonded and a burr maximum size becomes small. Additionally, since the diameter of the connecting portion becomes large as that end face melts, it follows that a connecting strength is increased. As this truncated cone form, there are a truncated cone form, a truncated pyramid form, and the like.

Here, in such a manufacturing method, in order to remove the burr, it is possible to remove the burr generated in a connecting portion periphery edge by more than two points argon arc welding. In such a burr removal means, the burr removal can be performed simply and without deteriorating the welding strength in comparison with a case where the burr removal is performed by a grinder.

Regarding symbol disclosed in drawing, 1 indicates sheathed glow plug, 2 indicates main metal shell, 4 indicates center electrode, 5 and 6 indicate axial shaft, 11 indicates heating coil (electric heat generator), 10 indicates heat resisting tube, 30*a* indicates small diameter portion and 30*b* indicates truncated cone portion.

MODE FOR CARRYING OUT THE INVENTION

Figure 1:
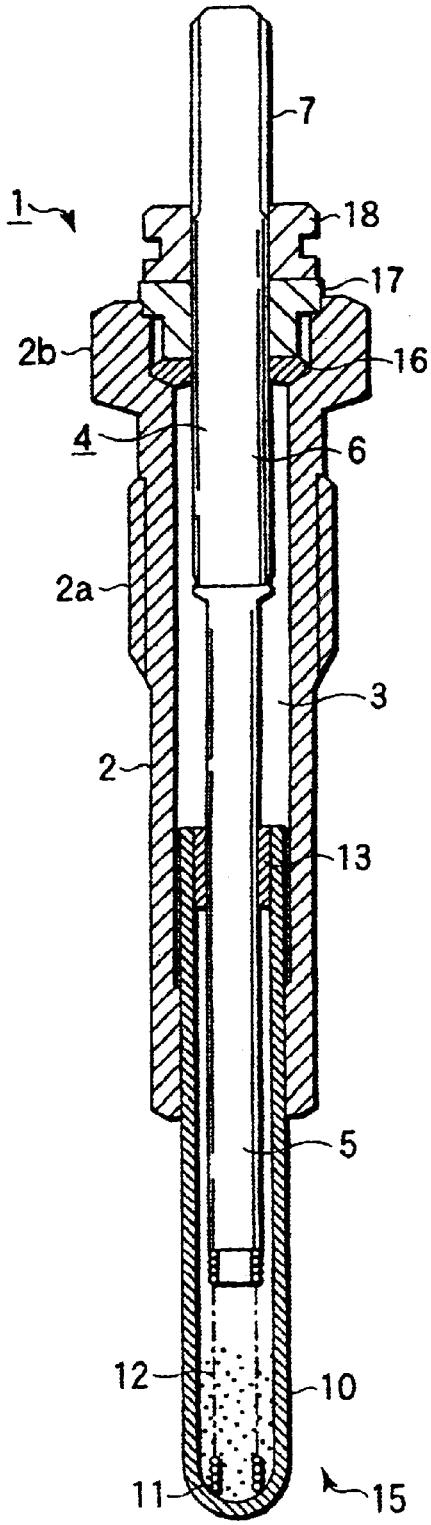
FIG. 1 is a lengthwise cross-section drawing of a sheathed glow plug 1 according to the invention.

One example of a sheathed glow plug 1 having a center electrode 4 according to the invention is explained on the basis of FIG. 1.

The sheathed glow plug 1 is composed by a cylindrical main metal shell 2 formed with a screw mounted on an engine, a metal made heat resisting tube 10 mounted on a leading end of the main metal shell 2, a center electrode 4 disposed in a center portion of the main metal shell 2, a heating coil (electric heat generator) 11 accommodated in the heat resisting tube 10, an insulation powder 12 filled in the heat resisting tube 10 under a state that the heating coil 11 and a leading end of the center electrode 4 are accommodated therein, and the like.

Here, the main metal shell 2 is formed of a low carbon steel, and on its outer wall there is applied a metal plating as occasion demands. On an outer periphery of the main metal shell 2, there are formed an attaching screw portion 2*a* and a hexagonal portion 2*b*, and in its center there is formed a through hole 3 along an axial direction.

Further, the heat resisting tube 10 is formed, for example, of a heat resisting stainless steel, its rear end side is pressure-inserted into the main metal shell 2, and its leading end is exposed to a combustion chamber (not shown) of diesel engine. The center electrode 4 is disposed coaxially with the main metal shell 2, and electrically insulated by securing a periphery gap with respect to the through hole 3 of the main metal shell 2.

The center electrode 4 is composed of a leading end axial shaft 5 of 2.7 to 3.6 mm in its outer diameter and a rear end axial shaft 6 of 3.2 to 5.0 mm in its main diameter. A shape of a connecting end portion of each of the axial shafts 5 and 6 constitutes an important part of the invention, and the center electrode 4 is formed by means of mutually connecting the connecting ends in an axial direction by a resistance welding. Further, a screw portion 7 is formed in a rear end portion of the rear end axial shaft 6.

In order to hold the center electrode 4 along the through hole 3, an upper end of the through hole 3 is enlarged in its diameter, an insulation plug 17 outwardly fitted to the center electrode 4 is mounted on an upper end of the main metal shell 2 through an O-ring 16, and a terminal nut 18 is screwed to the screw portion 7.

For the heating coil 11, there are used, for example, an iron chromium based wire rod and a nickel based wire rod, one end thereof (upper end in FIG. 1) is connected to a leading end of the center electrode 4, and the other end thereof is connected to a bottom portion of the heat resisting tube 10. Further, for the insulation powder 12 in the heat resisting tube 10, there is used a ceramics powder having an electric insulation property such as magnesia Additionally, to a rear end opening portion of the heat resisting tube 10, the insulation powder is filled and ,thereafter, a packing 13 having an insulation property is fitted.

Figure 2:
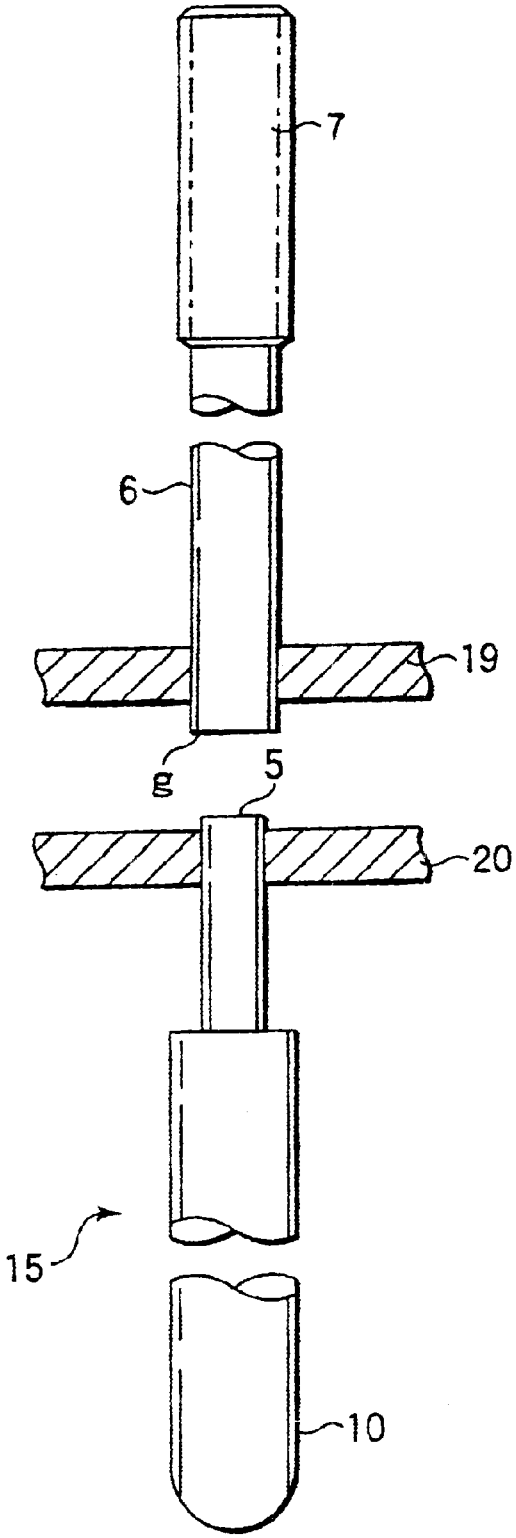
FIG. 2 is a side view showing means for connecting a center electrode.

In the glow plug 1 having such a constitution, means for connecting the center electrode 4 is explained in compliance with FIG. 2.

Before connecting the leading end axial shaft 5 and the rear end axial shaft 6, a sheathed heater portion 15 is assembled. As to the sheathed heater portion 15, one end of the heating coil 11 is welded to the leading end axial shaft 5 of the center electrode 4, thereafter the heating coil 11 is inserted into the heat resisting tube 10, and the other end of the heating coil 11 is welded to a bottom portion of the heat resisting tube 10. Thereafter, the insulation powder 12 is filled in the heat resisting tube 10, and the packing 13 is mounted to the opening portion of the heat resisting tube 10, thereby completing an assembly.

And, after the assembly of the sheathed heater portion 15 has been completed, the leading end axial shaft 5 and the rear end axial shaft 6 are held by the electrodes 19, 20 under a state that the leading end axial shaft 5 and the rear end axial shaft 6 are butted in an axial direction. And, in an argon atmosphere, an electric current is applied between the electrodes 19, 20, and the connecting end of the leading end axial shaft 5 and the connecting end of the rear end axial shaft 6 are mutually resistance-welded. In the resistance welding, in order to obtain a sufficient strength of the connecting portion, it follows that the connecting portion is molten until a weld burr protrudes from an outer diameter of the center electrode 4.

By the way, in the invention, the connecting portions of the leading end axial shaft 5 and the rear end axial shaft 6 are prescribed to a predetermined shape. Here, in a constitution of the 1st embodiment of FIG. 3, a main diameter ϕd of the leading end axial shaft 5 is made smaller than a main diameter ϕD of the rear end axial shaft 6. Here, it follows that a diameter of a connecting end (f) of the leading end axial shaft 5 is equal to the main diameter ϕd, and a diameter of a connecting end (g) of the rear end axial shaft 6 is equal to the main diameter ϕD. Accordingly, a diameter of the butting face becomes equal to the main diameter ϕd of the leading end axial shaft 5.

In such a constitution, the mutually butting faces of the connecting ends (f), (g) become a small area depending on a diameter of the small diameter side connecting end (f), and it follows that such butting faces are preferentially molten, and thereafter the other portions are welded. Therefore, even if the connecting end faces have an error in a right angle degree or they are rough faces, influence thereof can be suppressed, so that it follows that the resistance welding can be stably performed. Further, even if a burr(x) is generated in a periphery edge of the bonded faces by the resistance welding, since the area of the butting face is small, an amount of the generated burr is small. Additionally, so long as the burr (x) does not exceed the main diameter ϕD of the rear end axial shaft 6 of the large diameter side, it becomes an allowable range, so that a burr removal can be omitted or a simple burr removal work suffices.

Figure 4:
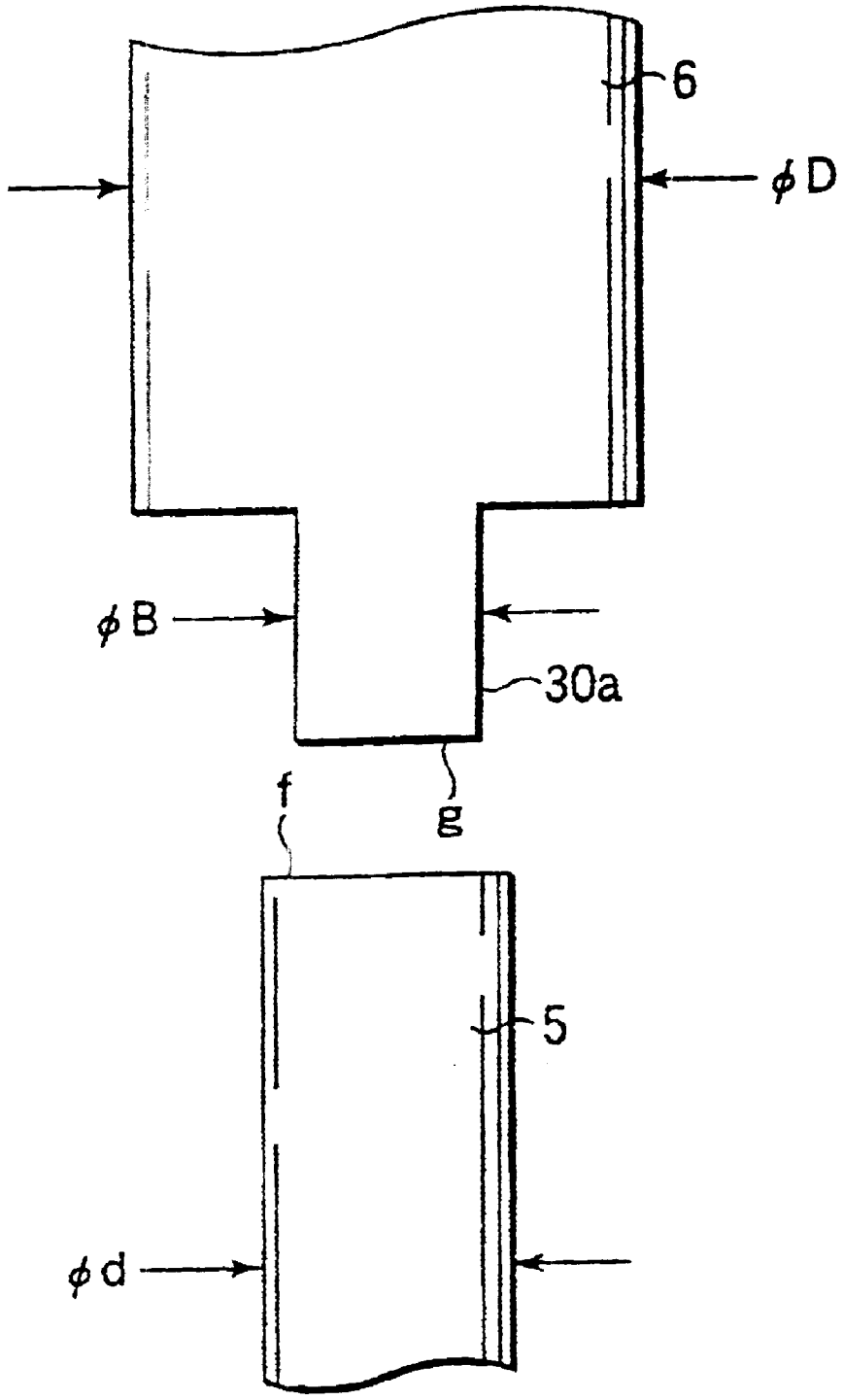
FIG. 4 is a side view showing the axial shafts 5 and 6 of a 2nd embodiment while being separated.

Further, in the constitution of a 2nd embodiment of FIG. 4, a small diameter portion 30*a* whose diameter is made smaller than the main diameter ϕD is formed, thereby forming a coaxial different diameter step shape. Here, a leading end of the 30*a* becomes a connecting end (g). By this, a diameter ϕB of the connecting end (g) is made smaller than the main diameter ϕD. Additionally, the leading end axial shaft 5 is made into an identical diameter shaper and its connecting end (f) is caused to have the same diameter as the main diameter ϕd. And, it is adapted such that the diameter ϕB of the connecting end (g) becomes smaller than the diameter ϕd of the connecting end (f) of the leading end axial shaft 5. By this, the butting faces are prescribed by the diameter ϕB of the connecting end (g).

In such a constitution, the diameter ϕB of the connecting end (g) of the small diameter side prescribing the butting faces can be made as small as possible without reducing the diameters of the axial shafts 5 and 6 so much. Therefore, it is possible to regularly bond the axial shafts 5 and 6 together to improve a coaxial property without reducing a strength of the center electrode. Further, since the diameter of the butting face is small, a maximum size of the burr becomes small as well, so that the burr removal becomes easy or unnecessary.

Figure 5:
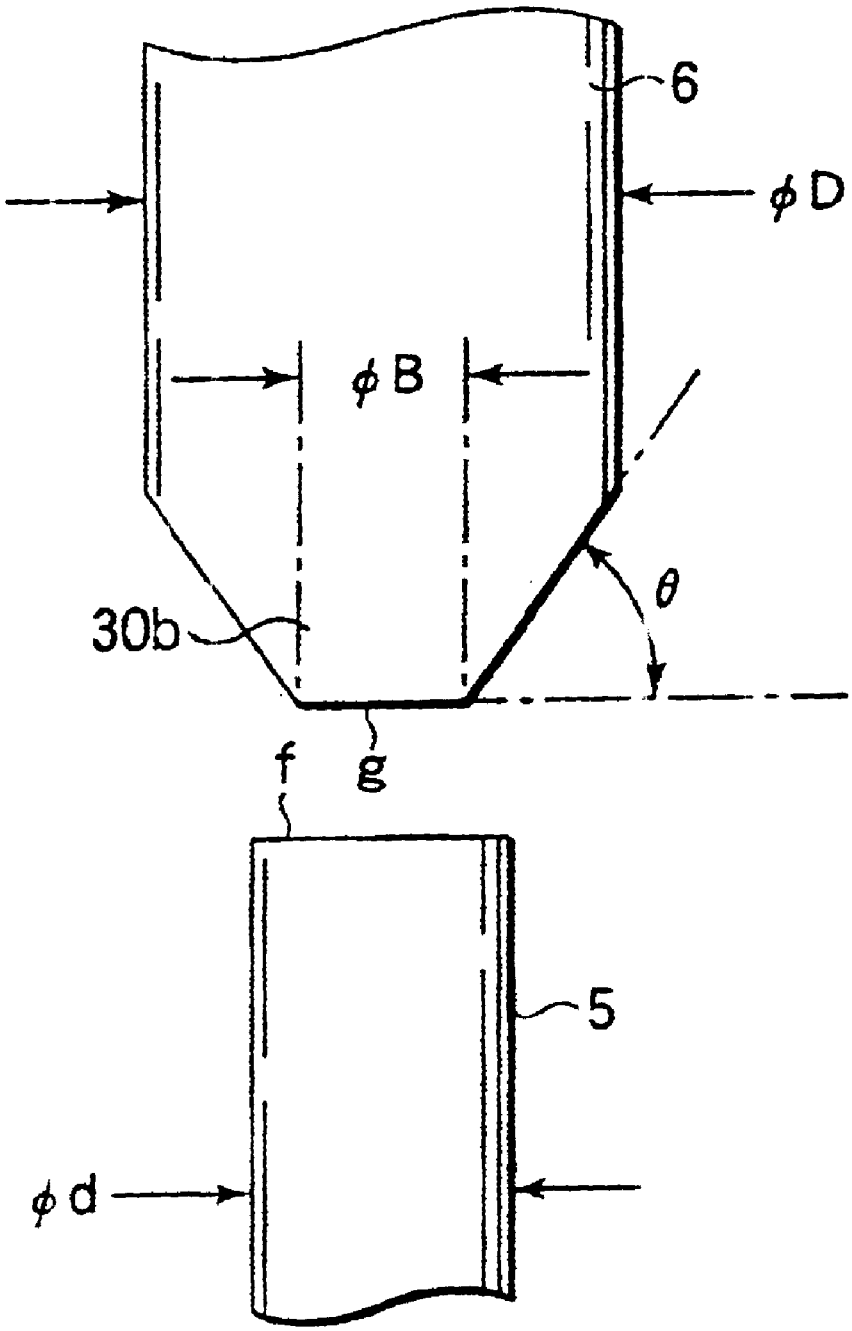
FIG. 5 is a side view showing the axial shafts 5 and 6 of a 3rd embodiment while being separated

Additionally, in the constitution of a 3rd embodiment of FIG. 5, a leading end portion of the rear end axial shaft 6 is formed into a tapering truncated cone form, and the connecting end (g) of a leading end of a truncated cone portion 30*b* is made smaller than the main diameter ϕD. In addition, it is adapted such that the diameter ϕB of the connecting end (g) is smaller than the diameter ϕd of the leading end axial shaft 5. A slant angle θ of a cone face of the truncated cone portion 30*b* with respect to the connecting end (g) is set to a range of 30 to 60°. Incidentally, besides the truncated cone form, the connecting side end portion can be made into a truncated pyramid form such as a truncated regular pyramid form. By making it into the truncated pyramid form in this manner, the butting face preferentially bonded can be made small, so that the maximum size of the burr becomes small. Additionally, since the bonded portion becomes large in its diameter as the end faces are molten, it follow that a connecting strength is increased.

Figure 6:
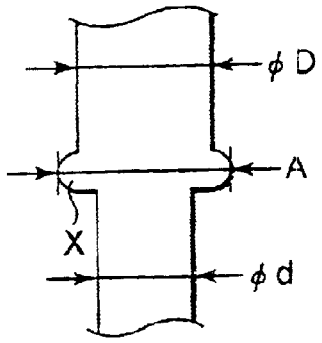
FIG. 6 is a table showing a relation of each diameter in case that the axial shafts 5 and 6 of the 1st embodiment are bonded.
Figure 7:
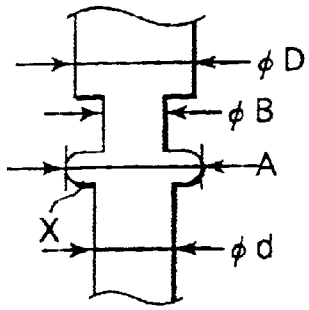
FIG. 7 is a table showing a relation of each diameter in case that the axial shafts 5 and 6 of the 2nd embodiment are bonded.
Figure 8:
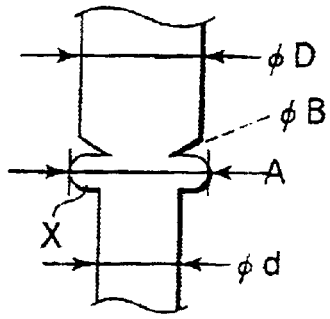
FIG. 8 is a table showing a relation of each diameter in case that the axial shafts 5 and 6 of the 3rd embodiment are bonded.

The axial shafts 5 and 6 each having such a shape were resistance-welded in the argon atmosphere as mentioned before, and relations between ϕD, ϕd, ϕB, a maximum size A of the burr (x) generated in the bonded portion and a magnitude of an eccentricity were investigated. FIG. 6 shows test results concerning the constitution of FIG. 3. FIG. 7 shows test results concerning the constitution, of FIG. 4, having the small diameter portion 30*a*. FIG. 8 shows test results concerning the constitution, of FIG. 5, having the truncated cone portion 30*b*. Additionally, FIG. 10 shows test results concerning FIG. 9 in which the axial shafts (b) and (c) each having the same diameter are bonded.

In each constitution, the ϕD, ϕd were made identical. Here, in comparing the results shown in FIG. 6, FIG. 7 and FIG. 8 concerning the invention with the maximum size A of the burr (x) of the results of FIG. 10 concerning the conventional constitution, it is understood that in ones of the shapes of the invention (FIG. 6, FIG. 7 and FIG. 8), the maximum size A of the burr becomes small in comparison with the axial shaft of the conventional shape of FIG. 10. Further, even in the invention, the maximum size of the burr is smallest in the shape, of FIG. 8, in which the truncated cone portion 30*b* is formed to the rear end axial shaft 6, and also the maximum size of the burr became smaller than the shape, of FIG. 7, having the small diameter portion 30*a*. Further, as to the shape having the small diameter portion 30*a* of FIG. 7, the maximum size of the burr became smaller than the constitution of FIG. 6 in which only the diameter was changed.

Figure 9:
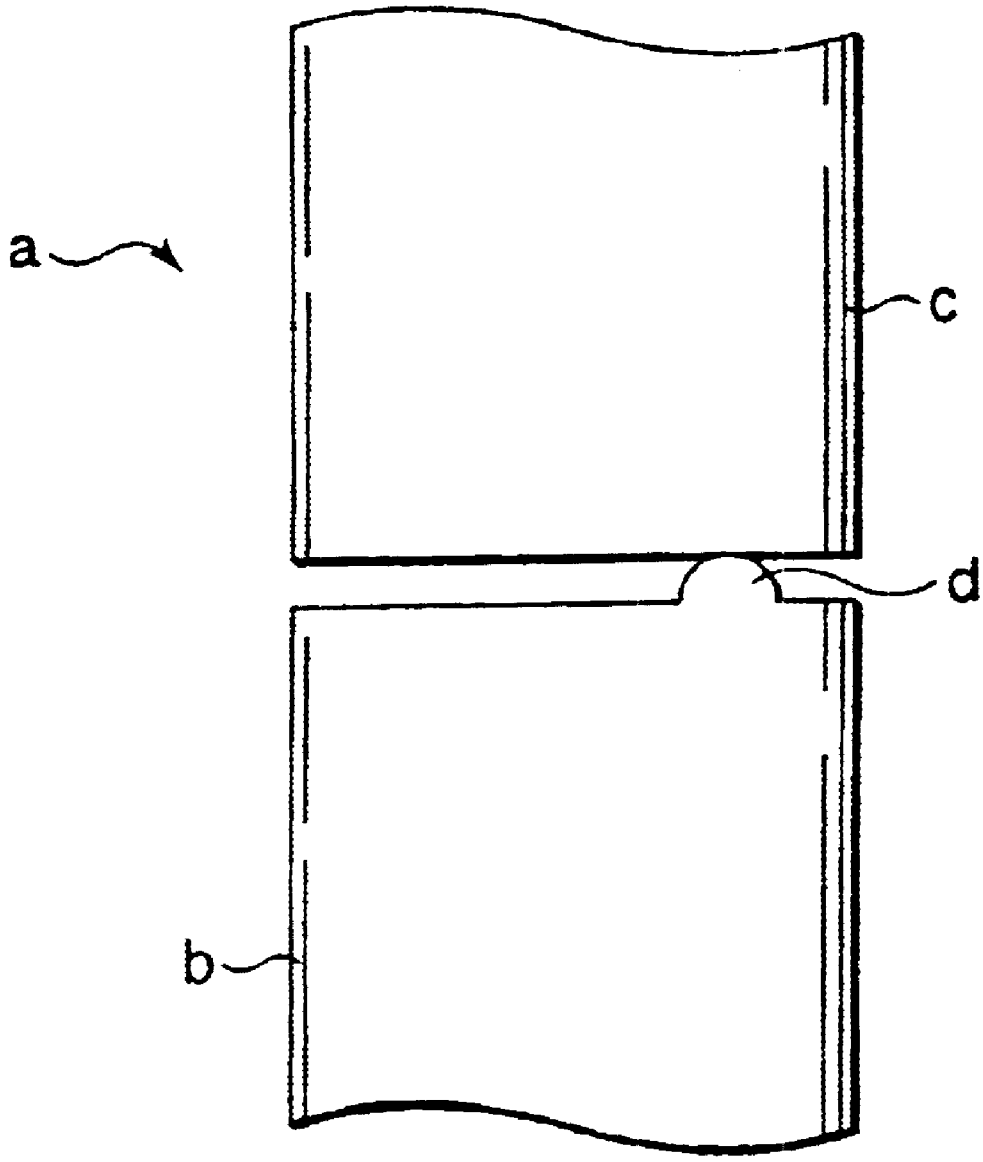
PRIOR ART FIG.9
FIG. 9 is a side view showing a state that axial shafts (b) and (c) of a conventional constitution are bonded.
Figure 10:
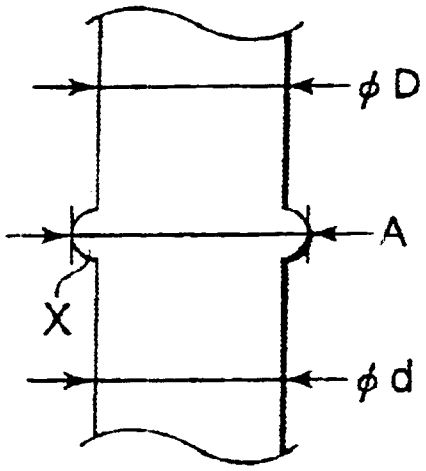
PRIOR ART FIG.10
FIG. 10 is a table showing a relation of each diameter in case that the axial shafts (b) and (c) of a conventional constitution are bonded.

That is, in such a constitution, as to the conventional shape of FIGS. 9 and 10, since the axial shafts 5 and 6 are coaxial, the butting face becomes ϕD (=ϕd) and, since the area is large, an amount of molten metal protruding outward becomes large, so that the molten metal spreads to the periphery and is cooled, thereby generating the large burr (x) of the maximum size.

Figure 3:
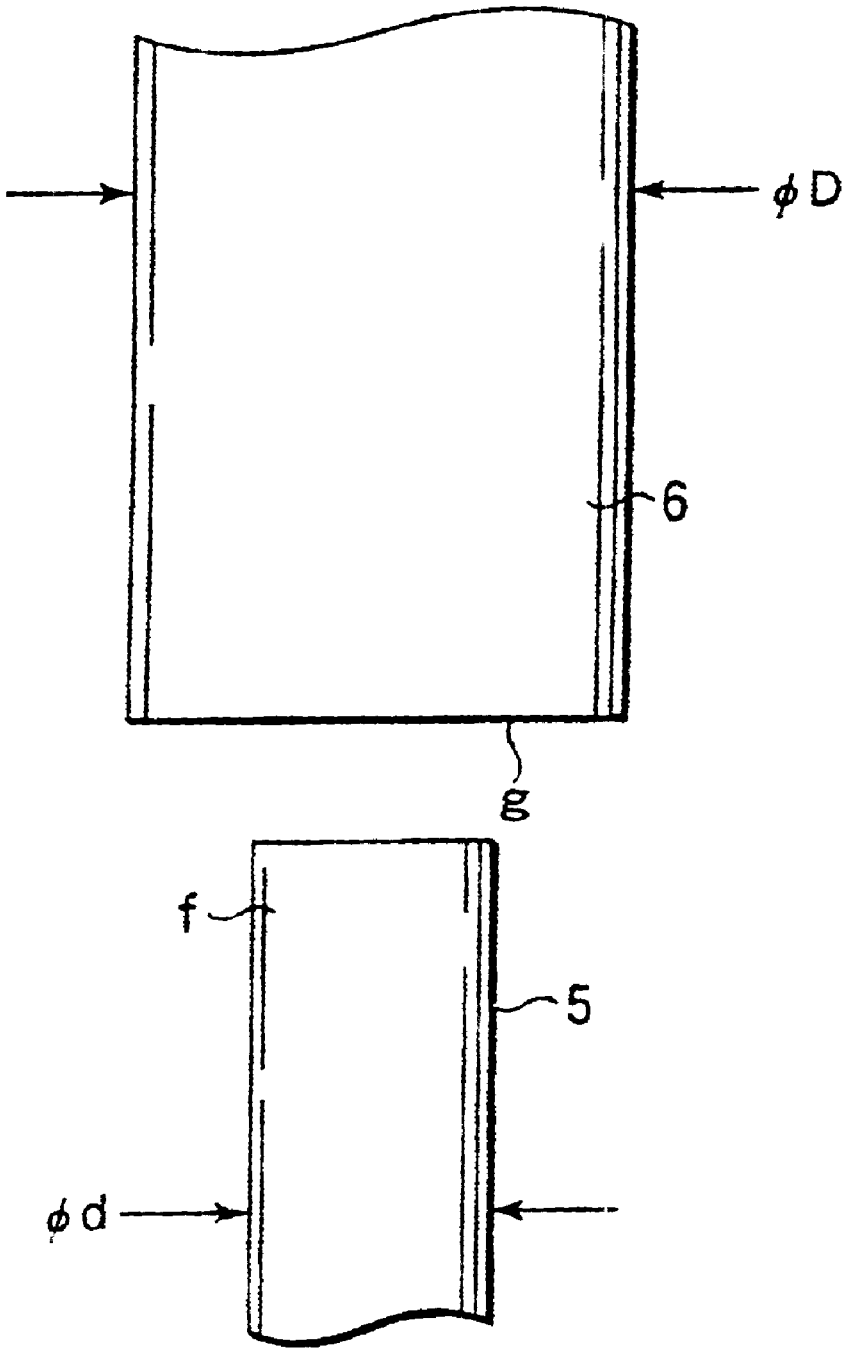
FIG. 3 is a side view showing axial shafts 5 and 6 of a 1st embodiment while being separated.

On the other hand, in the shape of FIGS. 3 and 6, firstly an area of the Ad becoming an initial contact face melts and its molten face spreads to an area of ϕD, and the molten metal spreads to the periphery and is cooled. Therefore, a butting area is smaller than FIG. 9, an amount of the molten metal protruding outside becomes small, the burr (x) protruding by about 0.5 mm than the ϕD is generated, and the maximum size of the burr (x) becomes small.

Further, in the shape of FIGS. 4 and 7, firstly an area of the ϕB becoming an initial contact face melts and its molten face spreads to an area of ϕd, the molten metal spreads to the periphery and is cooled, and the burr (x) whose maximum size is larger than the ϕd is generated. However, since such a burr is one bonded in the butting area of the ϕB smaller in diameter than the ϕD of the rear end axial shaft 6, there has been no case that the maximum size A protrudes larger than the ϕD which is the maximum diameter.

Further, in the shape of FIGS. 5, 8, first an area of the ϕB becoming an initial contact face melts and its molten face spreads to an area of ϕd, the molten metal spreads to the periphery and is cooled, and the burr (x) whose maximum size is larger than the ϕd is generated, but similarly to the above there has been almost no case that the maximum size A of such a burr (x) protrudes larger than the ϕD.

Figure 11:
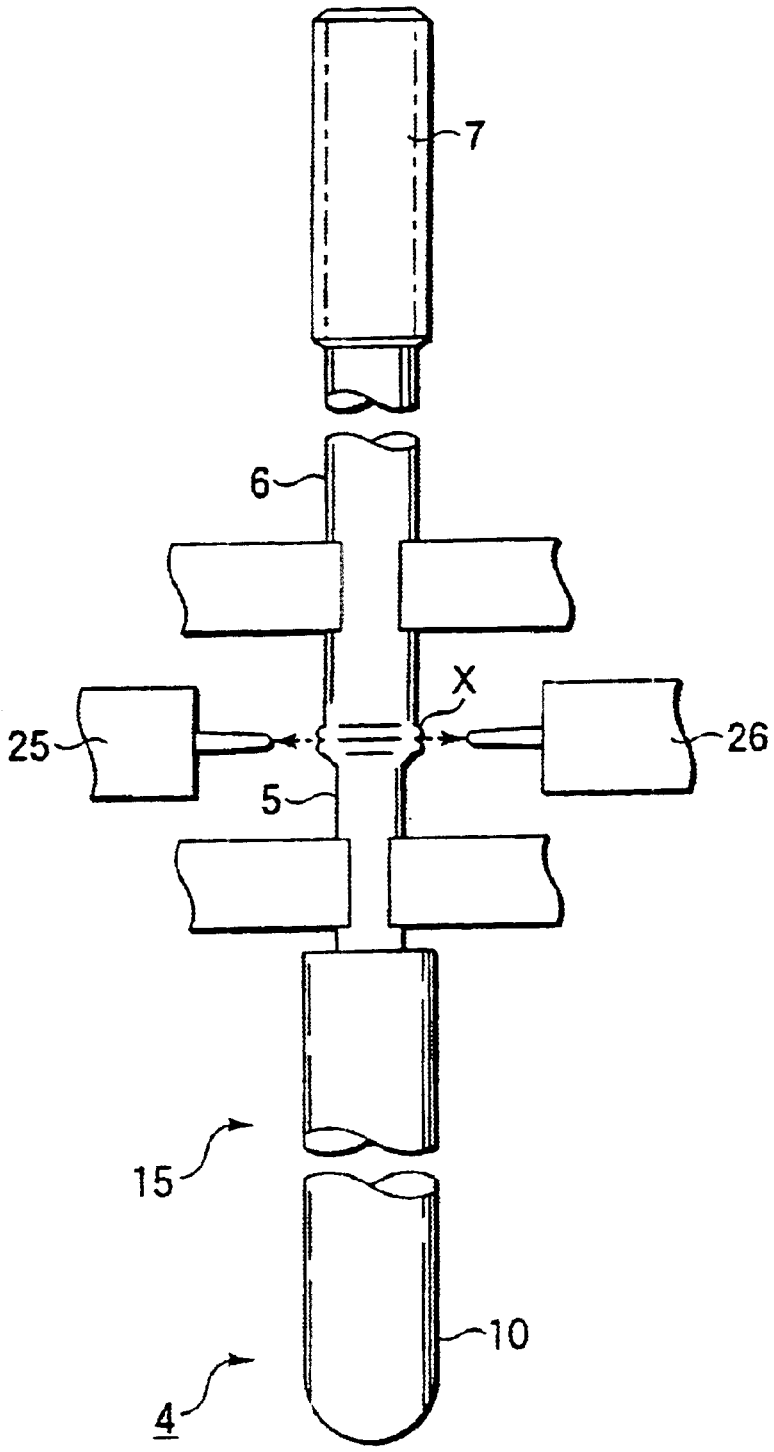
FIG. 11 is a concept view showing burr removal means.

Here, in order to remove the burr (x), although an argon arc welding shown in FIG. 11 was applied, an energy of about 210 A in terms of an electric current value was necessary in the conventional constitution of FIGS. 9 and 10. On the other hand, the energy of about 180 A in terms of the electric current value was necessary in the constitution of FIGS. 3 and 6. The energy of about 130 A was necessary in one having the small diameter portion 30*a* in the rear end axial shaft 6 of FIGS. 4 and 7. Additionally, the energy of about 100 A was necessary in one having the truncated cone portion 30*b* in the rear end axial shaft 6 of FIGS. 5 and 8. In this manner, it has been confirmed that, according to the shape of the invention, the energy for the burr removal can be reduced and the burr removal work becomes easy.

In this manner, according to the shape of the invention, a burr generation amount becomes small and, so long as the burr does not exceed the main diameter of the axial shaft of the large diameter side, the burr removal can be omitted or the simple burr removal work suffices.

On the other hand, it is studied about an influence of eccentricity owing to an influence of the connecting face between the leading end axial shaft 5 and the rear end axial shaft 6. In comparing the results shown in FIG. 6, FIG. 7 and FIG. 8 according to the invention with the result shown in FIG. 10 according to the conventional constitution with respect to an eccentricity size, it is understood that the ones of the shape of the invention (FIG. 6, FIG. 7 and FIG. 8) become small in the eccentricity size in comparison with the axial shaft of the conventional shape of FIG. 10. This tendency is the same as the case of the maximum size A of the burr. Further, even in the invention, the eccentricity size is smallest in the shape in which the truncated cone portion 30*b* is formed at the rear end axial shaft 6 of FIG. 8, and became smaller in its deviation size than the shape having the small diameter portion 30*a* of FIG. 7. Further, the shape having the small diameter portion 30*a* of FIG. 7 became smaller in its eccentricity size than the constitution, of FIG. 6, in which merely the diameter was changed. Incidentally, the eccentricity size is one obtained by measuring the eccentricity of the leading end axial shaft 5 at a position spaced by 10 mm from the welded connecting portion when the rear end axial shaft 6 is rotated by-being gripped by a three-pawl chuck at the position spaced by 10 mm from the welded connecting portion.

In the shape in each of FIG. 3, FIG. 4 and FIG. 5, the diameter of the butting face is made the ϕd (FIG. 3) or the ϕB (FIG. 4), and made smaller than the diameter of the other axial shaft. Accordingly, the connecting end becomes a small area in comparison with the conventional constitution of FIG. 9. Therefore, even if a connecting end face has an error in its right angle degree with respect to the axis or becomes a rough face, the influence thereof is small and, after the connecting face has been preferentially molten, it follows that the other portion is welded, so that it becomes possible to stably perform the resistance welding.

Further, in one adapted such that the above described connecting end of the axial shaft is made smaller in its diameter than the main diameter and the connecting side end portion of one axial shaft 6 of FIG. 5 is formed into the tapering truncated cone portion 30*b*, since the connecting portion becomes large in its diameter as the end face is molten, it follow that the connecting strength is increased.

Here, since a contact area in an initial period of the welding depends on the diameter of the small diameter side, in the constitution of FIG. 3, if the diameter of the front end side axial shaft 6 is made as small as possible, the aforesaid problem can be achieved. However, if the diameter is made too small, strength of the electrode cannot be maintained. Therefore, it is necessary to maintain the diameter ϕd to about 3 mm, and the butting face becomes relatively large in its diameter. However, the constitution of FIG. 4 and FIG. 5 has an advantage that the butting face can be made small in its diameter while maintaining the main diameter to a degree of the constitution of FIG. 3.

Additionally, as shown in FIG. 11, in case that the burr is generated, the argon arc welding is performed by disposing torches 25 and 26 of a welding machine in more than two places at positions opposed in a diameter direction of the center electrode 4. By this argon arc welding, the burr (x) generated in the connecting portion between the leading end axial shaft 5 of the center electrode 4 and the rear side axial shaft 6 of the center electrode 4 by the resistance welding is molten, so that the connecting portion is finished smoothly. In this manner, after the resistance welding has been performed, by performing the argon arc welding, it is possible to perform the burr removal easily and without deteriorating the welding strength of the connecting portion in comparison with a conventional case where the burr is removed by a grinder. Moreover, a work is not magnetized, so that no demagnetizing treatment is necessary.

In each of the above constitutions, it has been explained about the constitution wherein the main diameter ϕD of the rear end axial shaft 6 is made larger than the main diameter ϕd of the front end side axial shaft 5, and wherein the small diameter portion 30*a* and the truncated cone portion 30*b* are formed in the rear end axial shaft 6. However, it may be possible to enlarge the diameter of the front end side axial shaft 5 and form the small diameter portion 30*a* and the truncated cone portion 30*b* in the connecting end portion of the front end side axial shaft.

INDUSTRIAL APPLICABILITY

In the invention, in the sheathed glow plug, since the connecting portion of one axial shaft of the center electrode is made smaller in its diameter than that of the other axial shaft and they are connected by a resistance welding, the butting face between their connecting ends becomes a small area depending on the diameter of the small diameter side connecting end. Therefore, even if the connecting end face has an error in the right angle degree or is a rough face, its influence can be suppressed because the diameter of the butting face is small, so that it follows that the resistance welding can be stably performed. Further, it becomes possible to manufacture a sheathed glow plug which has no short-circuit and is suitable for making it long Even if the burris generated in the periphery edge of the connecting face by the resistance welding, the burr generation amount becomes small because the area of the butting face is small. And so long as the burr does not protrude than the main diameter of the axial shaft of the large diameter side, it becomes an allowable range, so that the burr removal can be omitted or a simple bur removal work suffices.

As a constitution capable of achieving the diameter relation between the connecting ends, in the constitution in which the connecting end of one axial shaft of the center electrode is made smaller in its diameter than the main diameter thereof and the diameter of that connecting end is made smaller than the connecting end of the other axial shaft, since it is one in which the main diameters of the axial shafts are made different and the connecting end of the large diameter axial shaft side is made smaller in its diameter than the connecting end of the other axial shaft, the diameter of the connecting end, of the small diameter side, prescribing the butting face can be made as small as possible without reducing the diameters of both axial shafts so much. Therefore, without reducing the strength of the center electrode, it is possible to regularly bond the axial shafts together, thereby improving the coaxial degree. Further, since the diameter of the butting face is small, the maximum size of the burr becomes small, so that the burr removal becomes easy or unnecessary.

Additionally, in the constitution in which the tapering truncated cone portion is formed in the connecting side end portion of one axial shaft and the diameter of that connecting end is made smaller than the connecting end of the other axial shaft, it is possible to reduce the area of the connecting end preferentially bonded, and the maximum size of the burr becomes small. Additionally, since the diameter of the connecting portion becomes large as its end face melts, it follows that the connecting strength is increased.

Further, as to such a manufacturing method, in the constitution in which it is adapted such that, in order to remove the burr, the burr generated in the connecting portion periphery edge is removed by the argon welding at more than two points, it is possible to perform the burr removal easily and without deteriorating the welding strength of the connecting portion in comparison with a conventional case where the burr is removed by a grinder. Moreover, a work is not magnetized, so that no demagnetizing treatment is necessary.

And, there is such an excellent effect that a sheathed glow plug having a stable quality, which is suitable for making it long and has no electric short-circuit can be provided.

What is claimed is:

1. A method of manufacturing a sheathed glow plug, the glow plug comprising:

a cylindrical main metal shell;

a heat resisting tube mounted to a leading end of a through hole of the main metal shell;

a center electrode, that comprises a leading end axial shaft and a rear end axial shaft coaxially welded each other, disposed in a center portion of the through hole of the main metal shell; and an electric heat generator received in the heat resisting tube, the electric heat generator having one end electrically connected to the center electrode, which comprises a process of manufacturing the center electrode comprising the steps of: making a diameter of a connecting end of one of the axial shafts smaller than a diameter of a connecting end of the other axial shaft; disposing the leading end axial shaft and the rear end axial shaft on the same axis; bringing the connecting ends into contact; and connecting them by a resistance welding after bringing of the connecting ends.

2. The method of manufacturing a sheathed glow plug according to claim 1, wherein the process of manufacturing the center electrode further comprises a step of making a diameter of the connecting end of the one of the axial shafts smaller than a main diameter of the one of the axial shafts.

3. The method of manufacturing a sheathed glow plug according to claim 1, wherein the process of manufacturing the center electrode further comprises a step of forming the connecting end of the one of the axial shafts at a connecting side of the one of the axial shafts by forming a different diameter protrusion portion whose diameter is smaller than that of a main portion of the one of the axial shafts.

4. The method of manufacturing a sheathed glow plug according to claim 1, wherein the process of manufacturing the center electrode further comprises a step of forming the connecting end of the one of the axial shafts at a connecting side of the one of the axial shafts by forming a tapering truncated cone portion.

5. A method of manufacturing a sheathed glow plug, the glow plug comprising:

a cylindrical main metal shell;

a heat resisting tube mounted to a leading end of a through hole of the main metal shell;

a center electrode, that comprises a leading end axial shaft and a rear end axial shaft coaxially welded each other, disposed in a center portion of the through hole of the main metal shell; and an electric heat generator received in the heat resisting tube, the electric heat generator having one end electrically connected to the center electrode, which comprises a process of manufacturing the center electrode comprising the steps of: making a diameter of a connecting end of one of the axial shafts smaller than a diameter of a connecting end of the other axial shaft; disposing the leading end axial shaft and the rear end axial shaft on the same axis; bringing the connecting ends into contact; connecting them by a resistance welding after bringing of the connecting ends; and removing a burr generated in the periphery of connecting portion by an argon arc welding.

6. The method of manufacturing a sheathed glow plug according to claim 5, wherein the process of manufacturing the center electrode further comprises a step of making a diameter of the connecting end of the one of the axial shafts smaller than a main diameter of the one of the axial shafts.

7. The method of manufacturing a sheathed glow plug according to claim 5, wherein the process of manufacturing the center electrode further comprises a step of forming the connecting end of the one of the axial shafts at a connecting side of the one of the axial shafts by forming a different diameter protrusion portion whose diameter is smaller than that of a main portion of the one of the axial shafts.

8. The method of manufacturing a sheathed glow plug according to claim 5, wherein the process of manufacturing the center electrode further comprises a step of forming the connecting end of the one of the axial shafts at a connecting side of the one of the axial shafts by forming a tapering truncated cone portion.

* * * * *